United States Patent [19]

Porter et al.

[11] Patent Number: 4,572,673

[45] Date of Patent: Feb. 25, 1986

[54] TREATMENT OF MOLTEN MATERIALS

[75] Inventors: Malcolm Porter, Cockermouth; Robert Dodgson, Workington, both of England

[73] Assignee: British Steel Corporation, England

[21] Appl. No.: 697,209

[22] Filed: Feb. 1, 1985

Related U.S. Application Data

[63] Continuation of Ser. No. 465,688, Feb. 11, 1983, abandoned.

[30] Foreign Application Priority Data

Feb. 12, 1982 [GB] United Kingdom ..... 8204212

[51] Int. Cl.[4] ..... B01F 11/02

[52] U.S. Cl. ..... 366/127; 366/114

[58] Field of Search ..... 164/468, 499, 504, 505, 164/511; 366/114, 115, 127, 273, 274, 341, 349

[56] References Cited

U.S. PATENT DOCUMENTS

| | | | |
|---|---|---|---|
| 3,153,820 | 10/1964 | Criner | 164/504 |
| 3,804,147 | 4/1974 | Babel | 164/468 |
| 3,882,923 | 5/1975 | Alberny | 164/504 |
| 4,139,048 | 2/1979 | Anderson | 164/504 |

FOREIGN PATENT DOCUMENTS

| | | | |
|---|---|---|---|
| 765059 | 9/1971 | Belgium | 164/468 |
| 6991565 | 10/1953 | United Kingdom . | |
| 2077161A | 12/1981 | United Kingdom . | |
| 2079196A | 1/1982 | United Kingdom . | |
| 2079195A | 1/1982 | United Kingdom . | |

*Primary Examiner*—Robert W. Jenkins

*Attorney, Agent, or Firm*—Bacon & Thomas

[57] ABSTRACT

The invention concerns the promotion of stirring of molten material (e.g. steel) within a receptacle such as a mould, vessel, or shell of a partially solidified metal strand emerging from a mould. Polyphase alternating currents are passed through electrically conductive elements located on, or forming part of, or lying adjacent to the receptable surface by joining both current connections of one or more transducers to the conductive elements to cause electrical currents to flow along paths in the elements to induce magnetic fields within the molten material and to promote stirring of the material.

13 Claims, 3 Drawing Figures

TREATMENT OF MOLTEN MATERIALS

This application is a continuation, of application Ser. No. 465,688, filed Feb. 11, 1983, now abandoned.

The invention relates to a method of and apparatus for promoting stirring of molten material within receptacles including casting moulds, vessels which in use contain molten material, and partially solidified metal strands emerging from casting moulds. In the latter case, the solidified outer shell of the strand forms the receptacle and the still molten metal, the molten material.

One stage in the production of many materials is the pouring of the material in a molten state into a chilled mould where initially the outer surface of the cast material cools and solidifies. Solidification may take place completely within the mould or the cast material may be withdrawn continuously from the mould and further cooled by sprays to form a completely solid strand. The mould may be open topped or shrouded, may be of any cross section and may be either of straight or curved profile. Typically, many metals (especially steel) are produced using this type of process known as continuous casting.

The physical properties of material solidified can often be improved if the molten material within the mould or within the emerging strand, can be stirred in order to break up the columinar structure which normally forms in the transition between molten and solid state. Certain modes of stirring can also be beneficial in moulds or vessels containing molten material for the dispersion or reduction of inclusions of unlike materials.

According to the present invention in one aspect there is provided a method of promoting stirring of molten materials contained within a receptacle in which polyphase alternating currents are passed through electrically conductive elements of or adjacent to the preceptacle surface by joining both current connections of one or more current transducers to the conductive elements to cause electrical currents to flow along paths in the elements to induce magnetic fields within the molten material and to promote stirring thereof.

According to the present invention in another aspect there is provided apparatus for promoting stirring of molten material contained within a receptacle, the apparatus including electrically conductive elements jointed to both current connections of one or more current transducers supplying polyphase alternating current, said elements being adapted and arranged to induce magnetic fields within the molten material to promote stirring thereof.

Individual high current, low voltage transducers may be connected to the conductive elements at locations between which electrical current is to be passed. Magnetic and/or insulating material may be connected to one or more of the conductive elements to determine the paths taken by the electrical current and, consequently, the degree and direction of stirring promoted within the molten material. The or each transducer may comprise a primary energising winding coupled to a secondary high current low voltage element by means of a ferromagnetic core of a laminar construction.

The invention will now be described by way of example only with reference to the accompanying diagrammatic drawings, in which.

Figure 1:
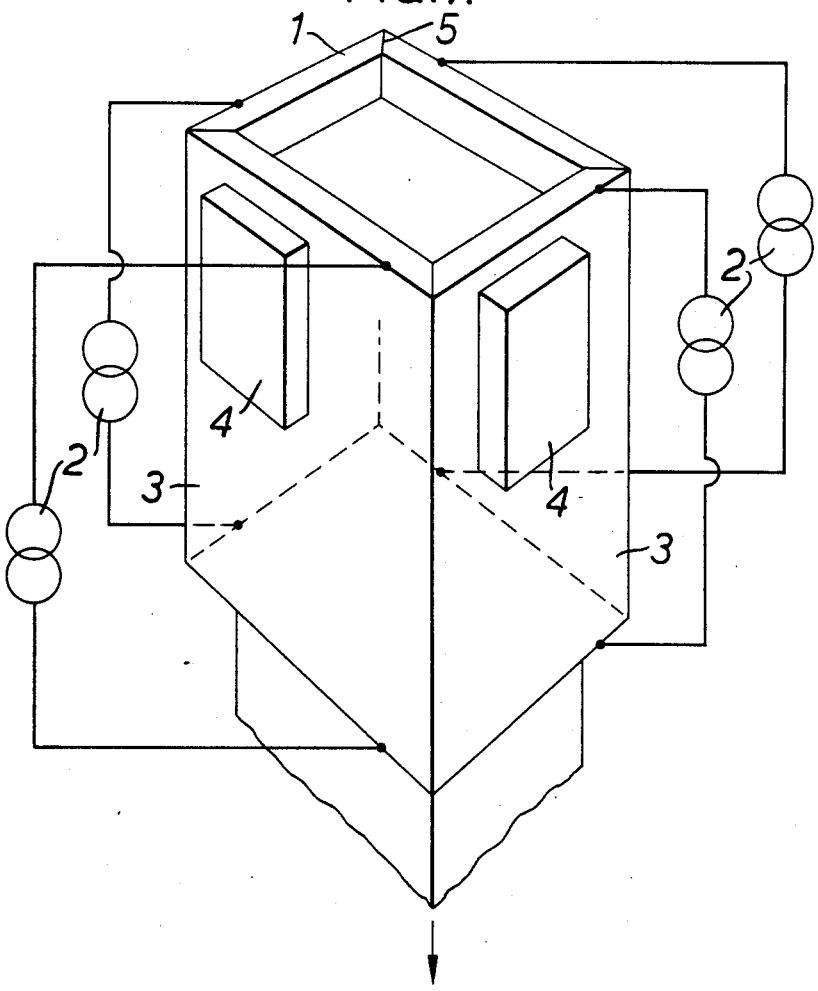
FIG. 1 is a perspective view of one apparatus in accordance with the invention.

The apparatus illustrated in FIG. 1 comprises a copper mould 1 for casting rectangular-section steel strands. The mould wells may be cooled by, for example, passing a coolant medium (eg. water) through channels formed in the mould walls.

Four current transducers 2 are shown connected one to each of the walls 3 of the mould 1. The four transducers are connected to a two phase alternating current supply with the transducers on opposite sides of the mould being connected to the same phase of the supply the connections being arranged to ensure currents flow in opposite directions within the mould on the opposite sides of the mould. Each transducer 2 comprises a primary energising winding coupled to a secondary high current, low voltage element by means of a ferromagnetic core of laminar construction. The transducers supply polyphase attenuating currents at low frequency, eg. at mains frequency of 30 HZ, 50 HZ, or 50 HZ. The current supplied by the transducer is normally between 1000 and 20,000 amperes.

Currents may be concentrated in the required paths within the mould wall by the positioning of magnetic material 4 around the mould and/or insulating material 5 located between adjacent wall elements. The location and magnitude of stirring forces are determined firstly by the current paths and secondly by the presence of the magnetic material. The insulating material may extend over the full depth of the mould wall or a part thereof. The magnetic material may be of a laminar or multiply construction and may extend over the full area of the mould outer surface or any part thereof; additionally, the magnetic material may extend above or below the mould. The insulating material may comprise a thin strip of for example Mica, or a coating of, for example a low conductivity material. By such means a magnetic field rotating about a vertical axis is created within the mould cavity to induce currents within the molten steel contained within the mould and generate forces by the inter-action of the induced currents and the rotating magnetic field thereby creating movement of the molten steel within the mould.

The transducers may be cooled by, for example, suitably directed air blasts or through a coolant medium circulated through channels formed in the transducers.

Figure 2:
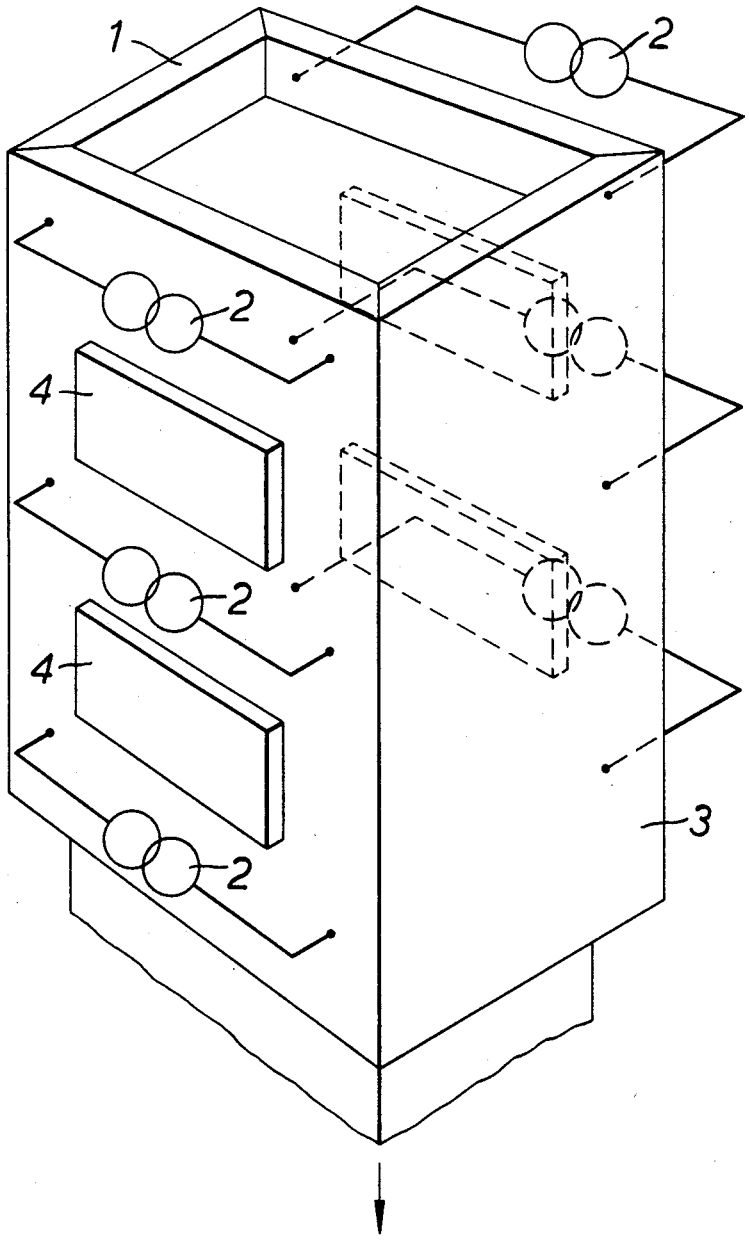
FIG. 2 is a perspective view of an alternative apparatus in accordance with the invention.

Variations of the stirring pattern of the molten steel can readily be achieved by changing the polarity of the current paths. Additionally, alternative modes of stirring can be achieved by positioning the connections of individual current transducers in alignments other than vertical. The direction of stirring within the molten steel is substantially parallel to a path joining the midpoints of individual transducers connections in phase sequence order. Thus, the transducer connections and the phase of the current in each transducer can be arranged to obtain any direction of stirring along a surface within the mould and substantially parallel to or concentric with the inner surface of the mould walls. In the arrangement shown in FIG. 2, the transducers 2 are connected to the mould walls in such a way that individual current transducer connections are horizontally aligned.

Current transducers 2 are arranged in vertical stacks of three, and are connected to a three phase alternating current supply at mains frequency. The currents which flow in the mould walls induce vertical stirring movements of the molten steel within the mould.

Figure 3:
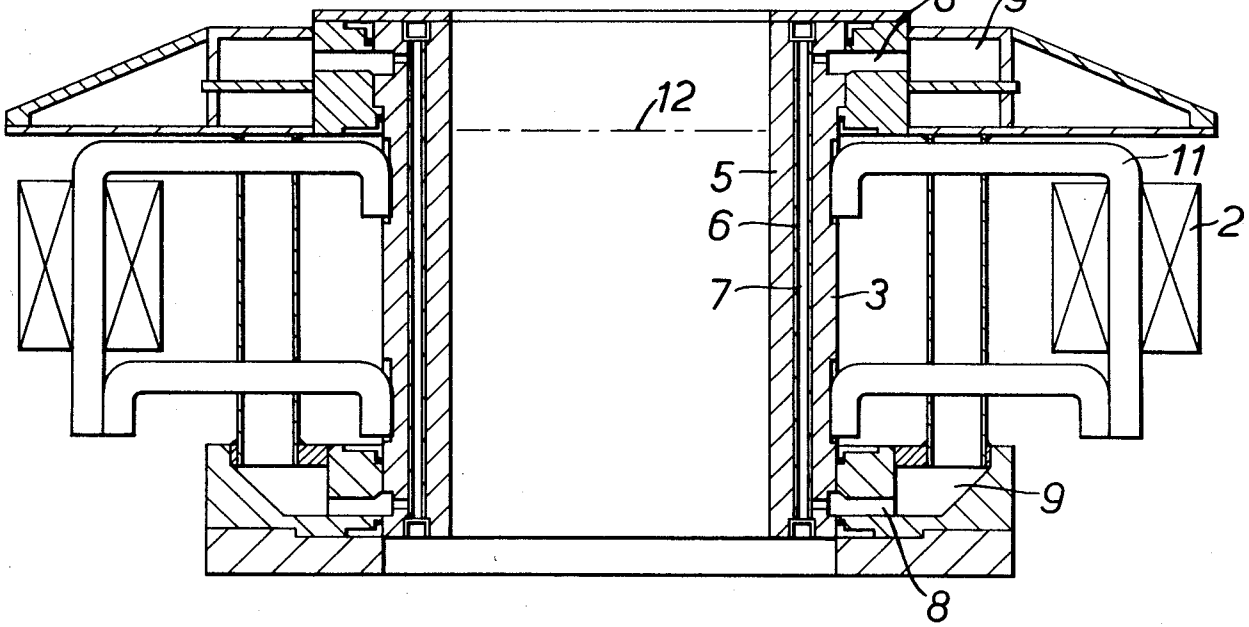
FIG. 3 is a sectional elevation of a mould configuration in accordance with the invention for the continuous casting of steel blooms.

The mould illustrated in FIG. 3 comprises a copper tube 5 of circular cross section having vertical channels 6 for the passage of a coolant, eg. water. Stainless steel retaining rods 7 are located in the channels. Coolant is recirculated to the channels 6 through side passageways 8, manifolds 9 and vertical tubes 10. Four transducers 2 (only two of which are shown) are spaced evenly about the mould circumference and are mounted on and connected to the mould wall through copper bars 11 which are brazed at their inner ends to the wall elements 3. The level of liquid metal to be maintained within the mould is indicated by broken line referenced 12. The copper bars 11 may be cooled by a coolant medium passing through channels formed in the bars.

The number of current paths employed within the mould walls of each of the foregoing embodiments can be arranged to match the size and sections of the material cast and the stirring pattern required.

The transducers 2 can be connected in a like manner to induce stirring within the molten material at a location away from the mould where the material section has already partially solidified. In such an arrangement elements of electrically conductive material similar to the mould wall elements 3 would be positioned adjacent to the partially solidified material to act as conductors for the currents.

Advantages enjoyed by the apparatus described include the fact that the mould walls necessary for the mechanical construction and physical cooling of the cast material are additionally employed as part of the electric circuit forming the coil which induces motion within the molten material, and that because the mould walls are in intimate contact with the cast material, high power electric consumptions are not required to generate the desired stirring action within the cast material.

It is to be appreciated that whereas the invention has been described with reference to the foregoing specific embodiments, various modifications can readily be made without departing from the scope of the invention. For example, the transducers may be connected to the electrically conductive walls of a vessel other than a casting mould to achieve a required stirring action. Further, the conductive elements may form only part of or be secured to the walls of the mould or vessel. Alternatively, discrete conductors may be positioned about and adjacent to the periphery of a partially solidified metal strand emerging from a casting mould to promote stirring of the solidifying molten metal contained within the strand. The discrete conductors may comprise vertically spaced annular conductors connected to individual transducers and positioned about the path to be taken by the emerging strand, or discrete panels located on one or more sides of the strand, or an array of vertical and/or horizontal copper bars connected to individual transducers, or an open framework of such bars.

We claim:

1. Apparatus for promoting stirring of molten material contained within a receptacle, said apparatus including electrically conductive elements joined to both current connections of one or more current transducers supplying polyphase alternating current, said elements being adapted and arranged to induce magnetic fields within the molten material to promote stirring thereof.

2. Apparatus as claimed in claim 1 wherein the conductive elements comprise wall elements of a mould or vessel which, in use, contains molten material.

3. Apparatus as claimed in claim 1 wherein the receptacle comprises a partially solidified metal strand emerging from a casting mould and wherein the conductive elements are positioned adjacent the path to be taken by such strand.

4. Apparatus as claimed in any one of claims 1 wherein the or each transducer comprises a primary energising winding coupled to a secondary high current low voltage element by means of a ferromagnetic core of laminar construction.

5. Apparatus as claimed in claim 1 wherein magnetic material is positioned on the or each of the conductive elements to determine the location and magnitude of the stirring induced within the molten material.

6. Apparatus as claimed in claim 5 wherein the magnetic material extends over discrete portions of the outer surfaces of the conductive elements.

7. A method of promoting stirring of molten metal material contained within a receptacle in which polyphase alternating currents are passed through electrically conductive elements comprising wall elements of a mold or vessel containing the molten material by joining both current connections of one or more transducers to the conductive elements to induce magnetic fields within the molten material and to promote stirring thereof.

8. A method of promoting stirring of molten material contained within a receptacle in which polyphase alternating currents are passed through electrically conductive elements positioned adjacent the path to be taken by a partially solidified metal strand emerging from a casting mold by joining both current connections of one or more current transducers to the conductive elements to cause electrical currents to flow along paths in the elements to induce magnetic fields within molten material contained within the partially solidified strand.

9. A method of promoting stirring of molten metal material contained within a receptacle in which polyphase alternating currents are passed through electrically conductive elements comprising wall elements of a mold or vessel containing the molten material by joining both current connections of one or more transducers supplying current at mains frequency to the conductive elements to induce magnetic fields throughout the molten material and to promote stirring thereof.

10. The method of claim 9, further comprising positioning magnetic material on the electrically conductive elements to control the location and magnitude of the stirring induced throughout the molten material.

11. A method of promoting stirring of molten material contained within a receptacle in which polyphase currents are passed through electrically conductive elements positioned adjacent the path to be taken by a partially solidified metal strand emerging from a casting mold by joining both current connections of one or more current transducers supplying current at mains frequency to the conductive elements to cause electric currents to flow along paths in the elements to induce magnetic fields throughout molten material contained within the partially solidified strand.

12. The method of claim 11, further comprising positioning magnetic material on the electrically conductive elements to control the location and magnitude of the stirring induced throughout the molten material.

13. Apparatus for promoting stirring of molten material contained within a receptacle, said apparatus including electrically conductive elements joined to both current connections of one or more transducers supplying polyphase alternating current, said elements being adapted and arranged to induce magnetic fields throughout the molten material to promote stirring thereof.

* * * * *